US005630329A

United States Patent [19]

Lauffer et al.

[11] Patent Number: 5,630,329

[45] Date of Patent: May 20, 1997

[54] WRISTWATCH BRACELET AND PROCESS FOR THE PRODUCTION THEREOF

[75] Inventors: Scott Lauffer, Horb; Pieter Kuschel, Schiltach, both of Germany

[73] Assignee: Junghans Uhren GmbH, Schramberg, Germany

[21] Appl. No.: 588,896

[22] Filed: Jan. 19, 1996

[30] Foreign Application Priority Data

Jan. 24, 1995 [DE] Germany ..... 195 01 952.0

[51] Int. Cl.[6] ..... A44C 5/04

[52] U.S. Cl. ..... 63/5.1; 63/11; 224/178

[58] Field of Search ..... 63/3, 5.1, 6, 11, 63/4, 9; 224/178, 179, 175, 164; 59/80, 93; 24/269

[56] References Cited

U.S. PATENT DOCUMENTS

| | | | |
|---|---|---|---|
| 2,002,233 | 5/1935 | Einsele | 63/3 |
| 3,844,136 | 10/1974 | Rieth et al. | 224/175 X |

FOREIGN PATENT DOCUMENTS

| | | | |
|---|---|---|---|
| 0 167 891 | 1/1986 | European Pat. Off. . | |
| 0 283 883 | 9/1988 | European Pat. Off. . | |
| 0 570 638 | 11/1993 | European Pat. Off. . | |
| 2 199 955 | 9/1976 | France . | |
| 1202046 | 9/1965 | Germany | 224/178 |
| 85/34 115 | 5/1987 | Germany . | |
| 86/02 996 | 7/1987 | Germany . | |
| 526648 | 8/1957 | Italy | 63/5.1 |

*Primary Examiner*—Kien T. Nguyen

*Attorney, Agent, or Firm*—Burns, Doane, Swecker & Mathis, L.L.P.

[57] ABSTRACT

A wristwatch bracelet segment includes a core and decorative elements mounted thereon in longitudinally spaced relationship. The core comprises first and second flexible core elements. The first core element is elastically stretchable and includes longitudinally spaced enlargements that define recesses therebetween. The decorative elements are mounted in respective recesses. The second core element is somewhat stiffer than the first core element and is installed through a longitudinal passage formed in the first core element. The first core element is stretched longitudinally to reduce its cross-sectional shape in order to enable the decorative elements (preferably of tubular shape) to be slid onto the first core element. The ends of the second core element are configured to receive connecting pins for connecting a clasp to the bracelet segment, and connecting the bracelet segment to a wristwatch casing.

10 Claims, 5 Drawing Sheets

WRISTWATCH BRACELET AND PROCESS FOR THE PRODUCTION THEREOF

BACKGROUND OF THE INVENTION

The invention concerns a wristwatch bracelet of the type comprising a flexible one-piece core, on which decorative elements are mounted in spaced-apart relationship, the decorative elements spaced apart by spacers mounted on the core, and also concerns a process for the production of such a wristwatch bracelet.

A wristwatch bracelet of the kind set forth above is known from European Publication 0 283 883-B1. The flexible core of that known wristwatch bracelet comprises a single material or a combination of materials. Preferably the core comprises silicone and a reinforcement extending in the longitudinal direction. That reinforcement is preferably a thin steel foil which is enclosed in the silicone core. Each of the individual decorative elements of that known wristwatch bracelet comprises lower and upper elements which are made from elastic material and are latched together. In that respect, the upper and the lower elements are of such a shape that they can be assembled, that is to say latched together, to form a respective decorative element, or can be taken apart. However, the operation of assembling the decorative elements from upper and lower elements involves a considerable amount of work. Likewise, particularly after such a bracelet has been in use for a long period of time, there exists the possibility of upper and lower elements of a decorative element becoming accidentally separated from each other and then lost.

A fancy article which may be for example a wristwatch bracelet is known from European Publication No. 0 198 279-Bl. That known bracelet has a core comprising a thermoplastic material and decorative elements which enclose the core over a part of its length. Each of the decorative elements comprises a second thermoplastic material and is fixedly joined to the core. In that arrangement the fixed connection between the core and the decorative element can be achieved by adhesion of the two plastic materials, but it is also possible for the core to be formed integrally with projections which latchingly engage into openings provided in the decorative elements. In the case of that known band-like fancy article, the decorative elements are arranged on the core in such a way that they cannot be lost, but the mechanical strength or the fatigue-strength characteristics of the band-like fancy article is dependent solely on the choice of material for the thermoplastic material of the core.

A bracelet comprising a flat flexible article is disclosed in German Document DE-86 02 996-Ul. On an inner side of the flat flexible article (facing the user's arm) there is a non-flexible, comparatively hard flexible member whose edges are flanged over in such a way that they enclose or embrace the edges of the flat flexible article.

European Publication No. 0 570 638-Al discloses a stretchable link-type bracelet for a wristwatch. It is proposed therein that each link be provided on its outside with a decorative element of plastic material.

French Patent 2,199,955 describes a watch bracelet having a flexible core with decorative elements arranged on the flexible core and which, similarly to the decorative elements referred to above as disclosed in EPO 0 283 883-Bl, are of a two-part configuration, that is to say, they have upper and lower elements which are assembled to form a respective unit. Consequently, the assembly and production expenditure for that wristwatch bracelet is comparable to that of the above-mentioned wristwatch bracelet disclosed in EPO 0 283 883-Bl.

European Publication No. 0 167 891-Bl discloses a wristwatch bracelet having a plurality of elements which are hingedly connected together and which form the links of the bracelet. The links engage directly one into the other and are held together by means of two flexible, non-stretchable bands. Those two bands extend through openings which are provided in each of the links on both sides of the longitudinal axis of the bracelet. With that known wristwatch bracelet therefore it is necessary for two bands to be threaded through the two openings in the links. In addition in this case the individual links bear directly and immediately against each other so that wear of the links is inevitable, in particular after the wristwatch bracelet has been in service for a long period of time.

German Document DE 85 34 115-Ul discloses a wristwatch bracelet which, similarly to the last-mentioned wristwatch bracelet disclosed in EPO 0 167 891-Bl, has bracelet links with lateral through holes for two bands. Between each pair of adjacent bracelet links of a first kind are bracelet links of a second kind so that the bracelet links of the second kind alternate with the first bracelet links. The first bracelet links are preferably of a leaf-like configuration, and the second bracelet links which are arranged between them are in the form of a roller or ball. Threading the two lateral bands both through the first and second links involves a considerable degree of manufacturing expenditure.

SUMMARY OF THE INVENTION

The object of the present invention is to provide a wristwatch bracelet and a process for the production thereof, in which it is comparatively easy, from a production point of view, to provide an inexpensive wristwatch bracelet with a decorative external appearance.

The present invention relates to a bracelet segment for a wristwatch comprising a first flexible, elastically stretchable core element of elongated strip shape. The first core element includes longitudinally spaced enlargements which constitute spacer members that define recesses between one another. The spacer members are interconnected by connector portions of the first core element which are of one piece construction with the spacer members. The first core element includes a passage extending longitudinally therethrough. Decorative elements are mounted on the first core element within respective ones of the recesses. A second flexible core element, stiffer than the first core element extends through the passage.

In a process aspect of the invention, the decorative elements are of tubular shape and are installed onto the first core element after the first core element has been longitudinally stretched in order to reduce its cross-sectional size.

The invention affords the advantage of comparatively inexpensive production of the wristwatch bracelet, in which respect the decorative elements may comprise a ceramic material, or metal such as titanium or the like. The first, that is to say top soft-elastic core element preferably comprises silicone and the second core element which is disposed therebeneath and which is stiffer and less stretchable than the first core, but nonetheless flexible, preferably comprises polyurethane. Other combinations of materials having those properties are also possible.

Because the wristwatch bracelet according to the invention only has one passage for the second, stiffer, flexible core element, the production expenditure is advantageously halved, in comparison with the known wristwatch bracelets of the above-described kind which have two lateral bands for holding the bracelet links together.

A further particular advantage of the wristwatch bracelet according to the invention is that the individual decorative elements are definedly spaced from each other by the spacer members which are integrally provided on the first core element, so that damage to or wear of the decorative elements is reliably prevented.

A further advantage lies in the fact that, in the wristwatch bracelet according to the invention, the individual decorative elements are in one piece, that is to say there is no need to assemble two parts to form a respective corresponding decorative element. The decorative elements are arranged on the wristwatch bracelet in such a way that they cannot be lost if the one-piece decorative elements are each of a sleeve-like or tubular cross-sectional profile which is closed.

BRIEF DESCRIPTION OF THE DRAWINGS

Further details, features, and advantages are apparent from the following description of an embodiment of the wristwatch bracelet according to the invention, which is illustrated in the drawing and in which.

DETAILED DESCRIPTION OF PREFERRED EMBODIMENTS OF THE INVENTION

Figure 1:
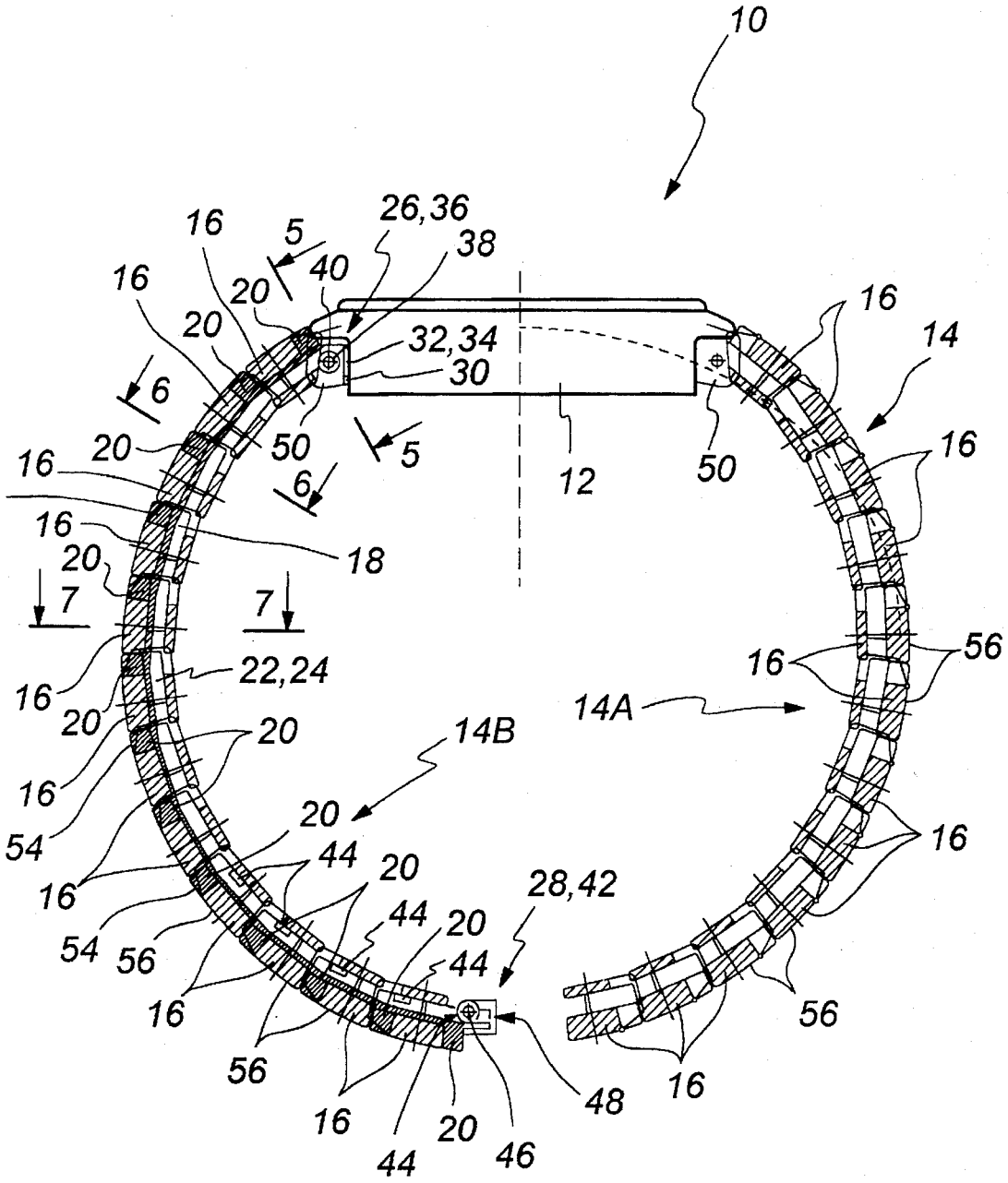
FIG. 1 is a diagrammatic view of a wristwatch, with a portion of a bracelet shown in the left-hand side of the figure being fully assembled, and with a bracelet portion shown in the right-hand side being only partially assembled.

FIG. 1 shows a wristwatch 10 with a watch casing 12 and a bracelet 14 formed of first and second segments 14A, 14B. For the sake of more clearly depicting the bracelet construction, the segments 14A, 14B are shown in different stages of assembly. That is, only decorative elements 16 of the bracelet are shown in the right-side segment 14A, whereas decorative elements 16, plus a first stretchable, soft core element 18 with spacer members 20 integrally formed thereon, as well as a passage 22 for a second comparatively hard or strong, flexible core element 24, are shown in the left-side segment 14B.

Figure 2:
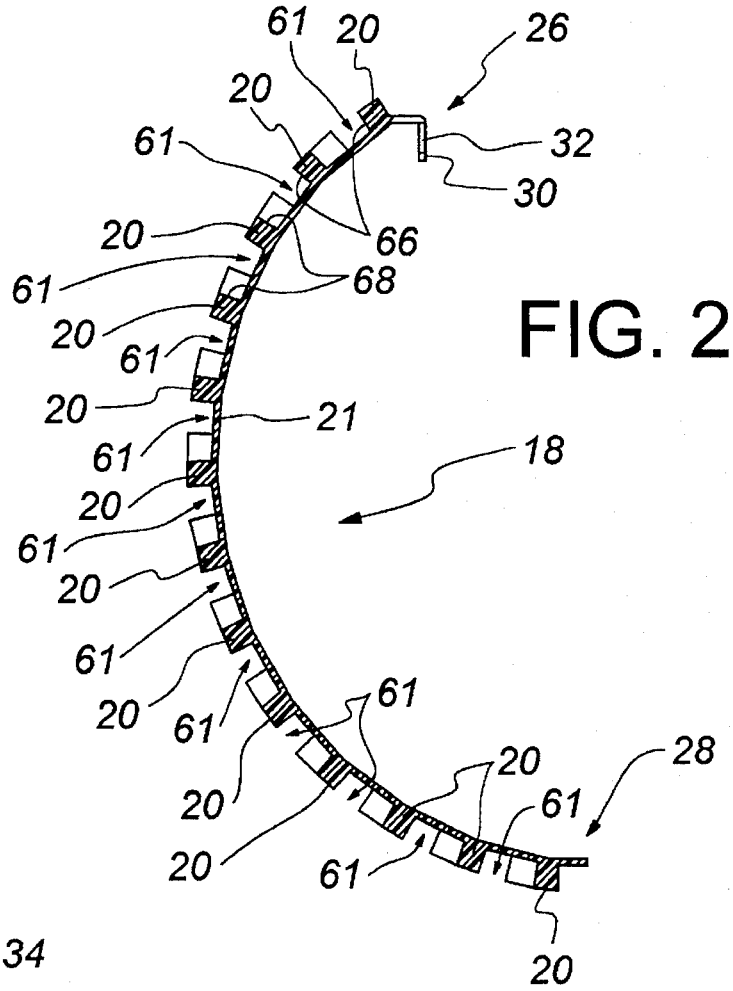
FIG. 2 is a view in longitudinal section through a first stretchable soft core element of a wristwatch bracelet shown in FIG. 1.

FIG. 2 shows in longitudinal section the first stretchable soft core element 18 (formed for example of silicone) along with the spacer members 20 which are formed integrally with connector portions 21 of the first core element. The first core element 18 is provided with a watch attachment end portion 26 and a second end portion 28 which is spaced therefrom. The watch attachment end portion 26 has an angled tongue 30 with a hole 32. The internal cross-section of the hole 32 of the tongue 30 at the watch attachment end portion 26 of the first core element 18 is adapted to the configuration of the cross-section of a projection 34 on the watch fixing attachment end portion 36 of the second, flexible core element 24 which is formed, for example of polyurethane, so as to be stiffer than the first core element 18, while being flexible and non-stretchable (see FIG. 3). The last-mentioned watch attachment end portion 36 of the second core element 24 is provided with a transversely extending hole 38 passing therethrough, which is provided for receiving and fixing a resilient watch fixing pin 40 (see FIG. 1).

Figure 3:
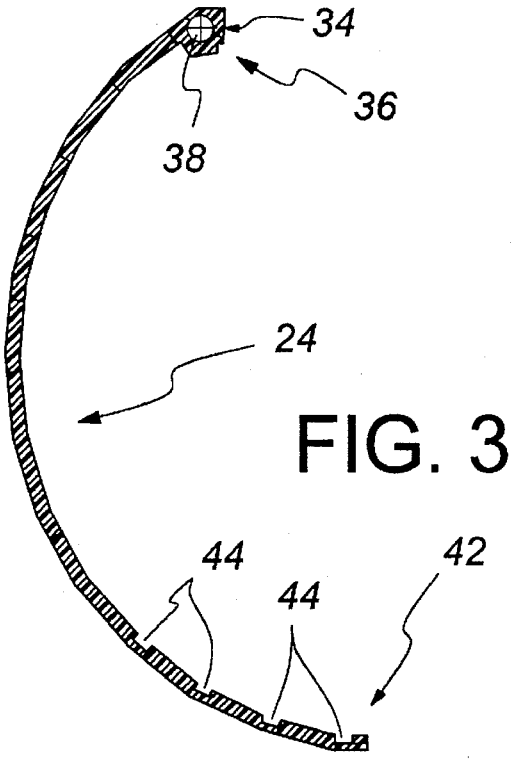
FIG. 3 is a view in longitudinal section through a second, stiffer, flexible core element of a bracelet shown in FIG. 1.
Figure 4:
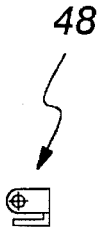
FIG. 4 is a side view of a fixing member for a bracelet fastener or clasp.

At its second end portion 42 remote from the watch attachment end portion 36, the second core element 24 is provided with a number of spaced-apart transverse channels 44, as can be seen from FIG. 3. The respective transverse channel 44 which is at the very end of the segment 14B serves to receive a resilient fastener or clasp fixing pin 46 (see FIG. 1) which is fixed to a clasp or fastener fixing element 48, as is shown in side view in FIG. 4. The fastener or clasp (not shown in the drawing) may be for example a so-called folding clasp.

Figure 5:
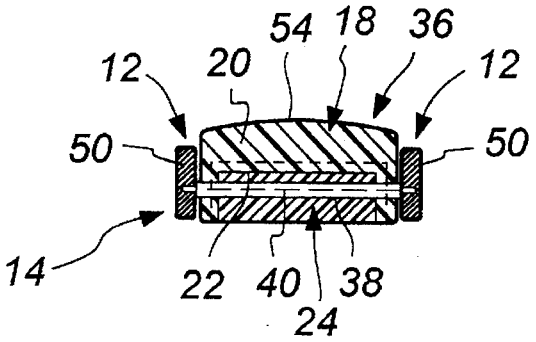
FIG. 5 is a view in section taken along line 5—5 in FIG. 1, that is to say a section through the first and the second core elements in the region of a resilient wristwatch fixing pin.

FIG. 5 is an enlarged view of the fixing arms 50 of the watch casing 12 (see also FIG. 1) and the resilient watch fixing pin 40 which extends between the two fixing arms 50. The watch fixing pin 40 extends through the through hole 38 extending transversely in the watch fixing end portion 36 in the second flexible core element 24, and through suitable locations 52 on the first stretchable soft core element 18. The sectional view in FIG. 5 extends through a spacer member 20 of the first core element 18. FIG. 5 shows not only the cross-section of the first core element, in the form of an inverted U-shape, but it also shows the convexly outwardly curved outside surface 54 of the corresponding integral spacer member 20 of the first core element 18.

Figure 6:
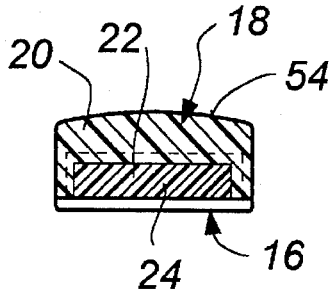
FIG. 6 is a view in section taken along line 6—6 in FIG. 1, that is to say in the region of a spacer member of the first core element.

Similarly to FIG. 5, FIG. 6 shows the first stretchable soft core element 18 with its cross-section in the form of an inverted U-shape, the sectional view in FIG. 6 also passing through one of the spacer members 20 of the first core element 18. The first core element 18 of inverted U-shaped cross-section defines a passage 22 in which the second flexible core element 24 is arranged. Reference numeral 54 in FIG. 6 also identifies a convexly curved outside surface of the corresponding spacer member 20. In accordance with the cross-sectional dimensions of the decorative elements 16, the individual spacer members 20 project beyond the first U-shaped core element 18 not only at the top side but also on the two mutually remote sides.

Figure 7:
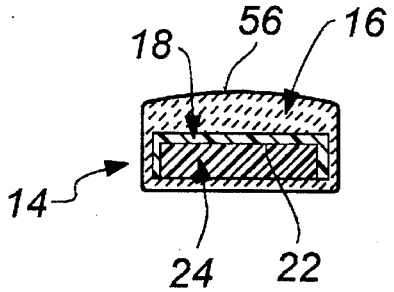
FIG. 7 is a view in section taken along line 7—7 in FIG. 1, that is to say in the region of a decorative element which is arranged without play between two spaced-apart spacer members.

FIG. 7 is a view in section through the first core element 18 which is of an inverted U-shaped cross-section, through a decorative element 18 and through the second core element 24 arranged in the passage 22 which is defined by the first core element 18 and the spaced-apart decorative elements 16. The individual decorative elements 16 are formed with a convexly curved outside surface 56 which conforms to the shape of the outside surface 54 of the spacer members 20 of the first core element 18.

Figure 8:
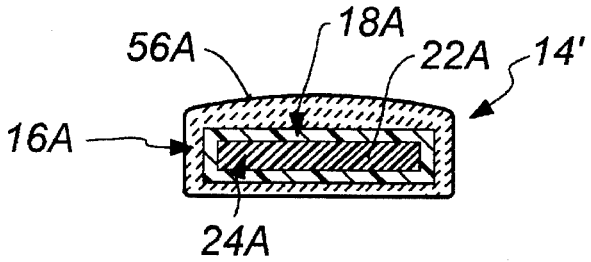
FIG. 8 is a sectional view similar to FIG. 7 which differs therefrom in that the first core element is not of a cross-sectional profile in the form of an inverted U-shape but is of a tubular cross-section.

FIG. 8 is a sectional view similar to FIG. 7 of a second embodiment of the first core element 18A which, unlike the inverted U-shaped cross-section shown in FIG. 7, is of a tubular cross-section defining a passage 22A for the second core element 24A. Reference numeral 16A in FIG. 8 denotes the corresponding decorative element of the bracelet 14' which has a convexly curved outside surface 56A.

Figure 9:
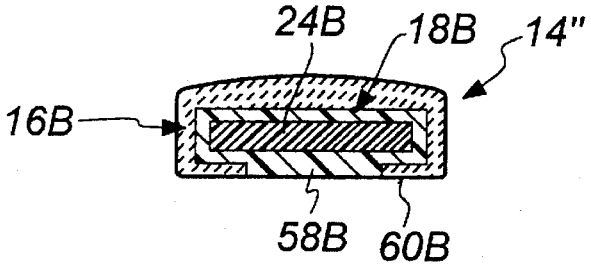
FIG. 9 is a sectional view corresponding to FIGS. 7 and 8 to show a further design which differs from the embodiment indicated in FIG. 8, in particular in that the decorative elements are not in the form of sleeve bodies which are closed in themselves in an annular configuration, but are in the form of one-piece clip-like sleeve bodies which are open at one side or their underside.
Figure 11:
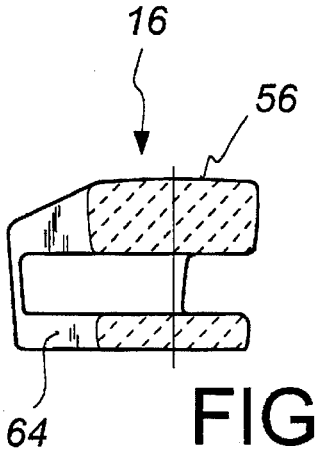
FIG. 11 is a view in section taken along line 11—11 in FIG. 10.
Figure 12:
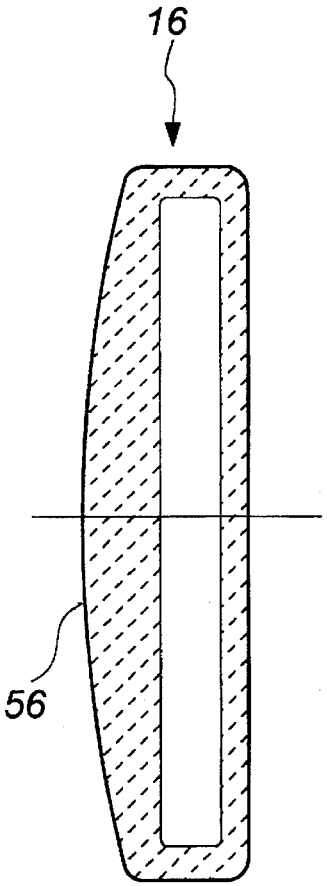
FIG. 12 is a cross-section of the decorative element taken along line 12—12 in FIG. 10.

While FIGS. 7 and 8 show sectional views of a decorative element 16 (formed for example of a ceramic material or metal such as titanium) which involves a quadrangular rectangular sleeve cross-section which is closed on itself, FIG. 9 shows a decorative element 16B with a quadrangular rectangular clip-like cross-section which is open at its underside. In this arrangement, the first core element 18B has at its underside a longitudinal raised portion 58B which is of a suitable configuration and which extends in the longitudinal direction thereof so as to afford a flat-surfaced underside 60B along the entire wristwatch bracelet 14".

The decorative elements 16 and 16A are closed, i.e., are in the form of one-piece sleeve bodies, and have been pushed onto the first core element 18 (preferably in the stretched condition thereof in which the cross-section thereof is therefore reduced) in a direction from the watch attachment end portion 26 or from the second end portion 28 (such as in the manner of stringing pearls or beads onto a string), it is possible for the decorative elements 16B as shown in FIG. 9 either to be pushed onto the first core element 18 in the longitudinal direction thereof in the manner just described above, or it is possible for those decorative elements 16B to be just fitted from the side onto the first core element.

After the individual decorative elements 16, 16A, 16B have been arranged in the receiving recesses 61 between adjacent spacer members 20 (see FIG. 2), the stretching effect in respect of the first stretchable soft core element 18 is released again, whereby the decorative elements 16 are retained between the spacer members 20 on the first core element 18. Then, the second core element 24 is introduced through the passage 22 of the intermediate structure consisting of the first core element 18 and the decorative elements 16 arranged thereon. Thereafter, a resilient watch fixing pin 40 is inserted through the through-hole 38 at the watch fixing end portion 36 of the second core element 24 in order to fix the corresponding watch bracelet 14 to the watch casing 12. In a corresponding manner, after the bracelet 14 has been suitably cut to length, a resilient fastener or clasp fixing member 46 is introduced into the last transverse channel 44 at the end, for fixing a fastener or clasp fixing element 48 of a fastener or clasp to the corresponding bracelet 14.

Figure 10:
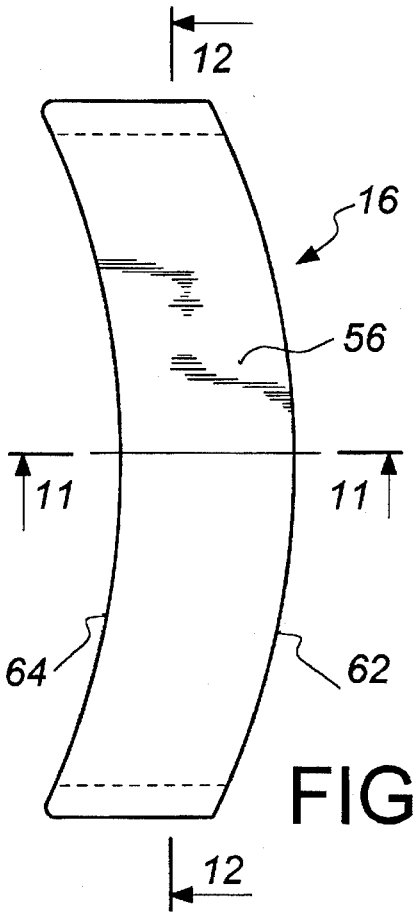
FIG. 10 is a plan view of a decorative element in the form of a sleeve body which is closed on itself in an annular configuration, on a greatly enlarged scale.
Figure 13:
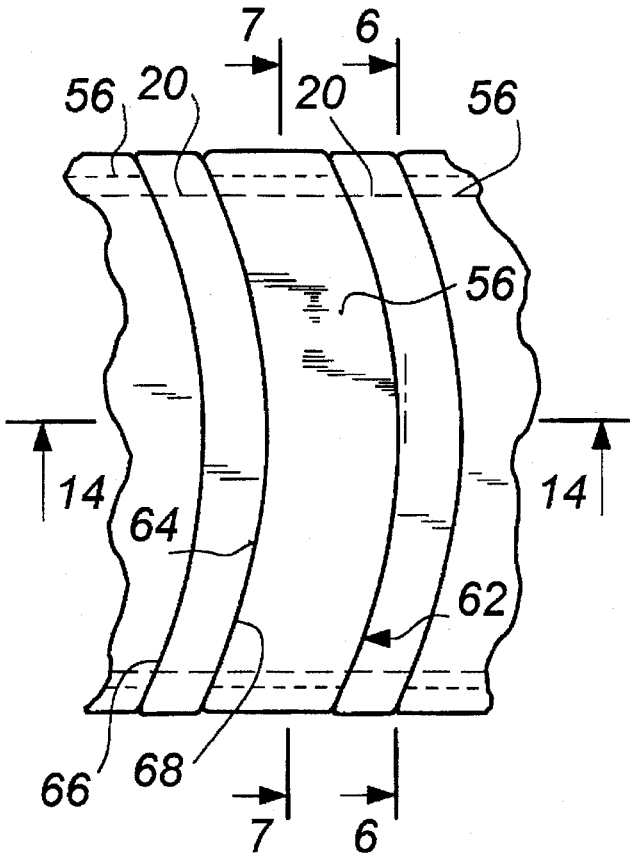
FIG. 13 is a fragmentary view of a bracelet portion shown in the left-hand side of FIG. 1, the view being taken from the left in FIG. 1.
Figure 14:
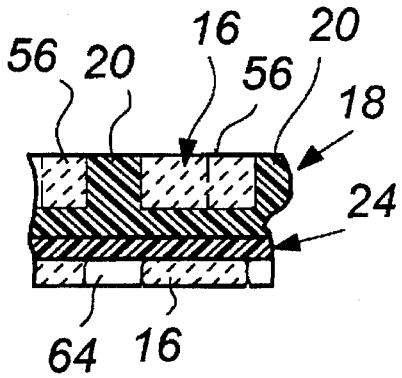
FIG. 14 is a sectional view taken along the line 14—14 in FIG. 13.

FIG. 10 is an enlarged plan view of a decorative element 16 which is not only provided with a cylindrically convexly curved outside surface 56, but also with a convexly curved end face 62 and with a concavely curved end face 64. In a corresponding fashion, the spacer members 20 of the first core element 18 have concavely and convexly curved faces 66 and 68, respectively (see FIGS. 2 and 13).

The same features are denoted in each of FIGS. 1 through 12 by the same references so that there is no need for all features to be described in full detail in connection with all those Figures.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A bracelet segment for a wristwatch comprising a first flexible, elastically stretchable core element of elongated strip shape, said first core element including longitudinally spaced enlargements constituting spacer members which define recesses between one another, said spacer members being interconnected by connector portions of said first core element which are of one-piece construction with said spacer members, said first core element including a passage extending longitudinally therethrough;

decorative elements mounted on said first core element within respective ones of said recesses; and a second flexible core element, stiffer than said first core element, extending through said passage.

2. The bracelet segment according to claim 1, wherein said first core element is of U-shaped cross-section to define said passage, a cross-sectional shape of said passage corresponding to a cross-sectional shape of said second core element.

3. The bracelet segment according to claim 1, wherein said first core element is of hollow tubular shape to define said passage, a cross-sectional shape of said passage corresponding to a cross-sectional shape of said second core element.

4. The bracelet segment according to claim 1, wherein said second core element includes one end defining a watch-attachment end having a transverse through-hole for receiving a connecting pin.

5. The bracelet segment according to claim 4, wherein at its opposite end said second core element includes a transverse channel for receiving a pin to attach a clasp to said second core element.

6. The bracelet according to claim 1, wherein one end of said second core element includes a transverse channel for receiving a pin to attach a clasp to said second core element.

7. The bracelet according to claim 1, wherein each of said spacer members includes concave and convex surfaces each facing in a longitudinal direction, each of said recesses being defined by said convex surface of one of said spacer members and said concave surface of an adjacent spacer member, each of said decorative elements including concave and convex surfaces facing respective ones of said concave and convex surfaces of its respective recess.

8. A process for making a bracelet segment of a wristwatch, comprising the steps of:

A) providing a first flexible, elastically stretchable core element of elongated strip shape and including longitudinally spaced enlargements constituting spacer members which define recesses between one another, said spacer members being interconnected by connector portions of said first core element which are of one-piece construction with said spacer members, said first core element including a passage extending longitudinally therethrough;

B) installing decorative elements into respective ones of said recesses; and,

C) inserting a second flexible core element, stiffer than said first core element, through said passage.

9. The process according to claim 7, wherein step B comprises longitudinally stretching said first core element to reduce its cross-sectional size, sliding said decorative elements onto said stretched first core element, and then releasing said first core element.

10. The process according to claim 8, wherein step C is performed following step B.

* * * * *